US009460678B2

(12) United States Patent
Ito

(10) Patent No.: US 9,460,678 B2
(45) Date of Patent: Oct. 4, 2016

(54) ELECTRO-OPTIC DEVICE, DRIVING METHOD FOR ELECTRO-OPTIC DEVICE AND ELECTRONIC DEVICE

(71) Applicant: SEIKO EPSON CORPORATION, Tokyo (JP)

(72) Inventor: Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 174 days.

(21) Appl. No.: 14/515,791

(22) Filed: Oct. 16, 2014

(65) Prior Publication Data

US 2015/0109270 A1 Apr. 23, 2015

(30) Foreign Application Priority Data

Oct. 18, 2013 (JP) ..... 2013-217077

(51) Int. Cl.

*G09G 3/36* (2006.01)
*G09G 3/00* (2006.01)
*G09G 3/20* (2006.01)

(52) U.S. Cl.

CPC ..... *G09G 3/3677* (2013.01); *G09G 3/003* (2013.01); *G09G 3/20* (2013.01); *G09G 3/3648* (2013.01); *G09G 3/3688* (2013.01); *G09G 2310/0202* (2013.01); *G09G 2310/0248* (2013.01); *G09G 2310/06* (2013.01); *G09G 2310/08* (2013.01); *G09G 2320/0209* (2013.01); *G09G 2320/0214* (2013.01); *G09G 2320/0626* (2013.01); *G09G 2340/0435* (2013.01); *G09G 2360/14* (2013.01); *G09G 2360/141* (2013.01); *G09G 2360/144* (2013.01)

(58) Field of Classification Search

CPC ... G09G 3/3659; G09G 3/3677; G09G 3/001
USPC ..... 345/212
See application file for complete search history.

(56) References Cited

U.S. PATENT DOCUMENTS 7,538,754 B2 * 5/2009 Tsuda ..... G09G 3/3688 345/100
7,944,414 B2 * 5/2011 Shirasaki ..... G09G 3/3225 345/77
8,547,304 B2 * 10/2013 Ito ..... G09G 3/3688 345/76

(Continued)

FOREIGN PATENT DOCUMENTS

JP 2000-242194 A 9/2000
JP 2009-025436 A 2/2009

(Continued)

*Primary Examiner* — Temesgh Ghebretinsae
*Assistant Examiner* — Benyam Ketema
(74) *Attorney, Agent, or Firm* — Maschoff Brennan

(57) ABSTRACT

When a 2D display is performed, a controller causes a first selection signal to be in an active state during a given period, and causes a second selection signal to be in the active state during another given period after causing the first selection signal to be in a non-active state. When a 3D display is performed, the controller causes the first selection signal to be in the active state at a given timing point, cause the second selection signal to be in the active state during a period when the first selection signal is in the active state, and thereby cause an overlapping period to arise during a period which is part of a selection period for selecting signal lines corresponding to the first selection signal, and which is part of another selection period for selecting signal lines corresponding to the second selection signal.

17 Claims, 11 Drawing Sheets

(56) References Cited

U.S. PATENT DOCUMENTS

2004/0196248 A1* 10/2004 Sekine ..... G09G 3/3614 345/100
2005/0041488 A1* 2/2005 Ito ..... G11C 5/063 365/199
2008/0075417 A1* 3/2008 Mizuno ..... G11B 20/10527 386/241
2008/0309599 A1* 12/2008 Tsuda ..... G09G 3/3688 345/88
2009/0122035 A1* 5/2009 Ito ..... G09G 3/2011 345/204
2009/0179835 A1 7/2009 Ito
2011/0057917 A1* 3/2011 Ryu ..... G09G 3/3233 345/211
2011/0063533 A1* 3/2011 Kim ..... H04N 13/0456 349/15
2011/0116166 A1* 5/2011 Jung ..... G02B 27/26 359/465
2011/0175857 A1* 7/2011 Kim ..... G02B 27/2214 345/204

FOREIGN PATENT DOCUMENTS

JP 2009-168849 A 7/2009
JP 2012-194326 A 10/2012

* cited by examiner

ELECTRO-OPTIC DEVICE, DRIVING METHOD FOR ELECTRO-OPTIC DEVICE AND ELECTRONIC DEVICE

BACKGROUND

1. Technical Field

The present invention relates to a technology field for an electro-optic device, such as a liquid crystal device, a driving method for an electro-optic device, and an electronic device, such as a liquid crystal projector, which is configured to include the electro-optic device.

2. Related Art

There has been proposed a three-dimensional viewing method employing a frame sequential method which allows a right-eye image and a left-eye image to be alternately displayed on a time division basis. During a period when any one of a right-eye image and a left-eye image changes to the other one thereof, the mixture of the right-eye image and the left-eye image (i.e., crosstalk) occurs, and thus, when an observer views a displayed image, it becomes difficult for the observer to perceive a distinct three-dimensional appearance. In order to solve this problem, for example, in JP-A-2009-25436, there has been disclosed a technology which disables an observer to view a displayed image during a period when any one of a right-eye image and a left-eye image changes to the other one thereof (that is, a period when a right-eye image and a left-eye image are mixed) by causing both of a right-eye shutter and a left-eye shutter, which are incorporated in three-dimensional spectacles, to be in a closed state.

Specifically, a right-eye period corresponding to a right-eye image and a left-eye period corresponding to a left-eye image are set alternately. In the right-eye period, a displayed image is updated from a left-eye image to a right-eye image in the anterior half portion thereof and the right-eye image is displayed in the posterior half portion thereof; while, in the left-eye period, a displayed image is updated from a right-eye image to a left-eye image in the anterior half portion thereof and the left-eye image is displayed in the posterior half portion thereof. In the anterior half portion of each of the right-eye period and the left-eye image, both of the right-eye shutter and the left-eye shutter are controlled so as to be in a closed state. Accordingly, the mixture of a right-eye image and a left-eye image (i.e., crosstalk) is not perceived by an observer.

In a three-dimensional viewing (3D) display which allows a right-eye image and a left-eye image to be alternately displayed, such as is disclosed in JP-A-2009-25436, however, it is necessary to speed up a transfer speed of image signals as well as an operation speed of each of driving circuits so that a frame frequency for displaying images can be more than twice as high as a frame frequency in a two-dimensional viewing (2D) display. For example, in the two-dimensional viewing (2D) display, a frame frequency of 60 Hz is used; while, in the three-dimensional viewing (3D) display, a double speed driving method, in which a frame frequency (a vertical scanning frequency) is made 120 Hz, is employed.

In the case where the double speed driving method is employed, there is a problem that the length of a selection period for selecting one of signal lines becomes short, thereby causing a trouble to occur in writing of display data signals into pixels, so that the quality of a displayed image is degraded. For this reason, in order that the length of the selection period does not become short, in an existing configuration, for example, four or six driving ICs are used and the entire driving operations are separately performed by two or three driving ICs for each of a horizontal direction and a vertical direction.

Nevertheless, in the case where four of six driving ICs are used, there is a problem that manufacturing cost is increased. Moreover, in the case where four of six driving ICs are used, it is necessary to provide two wirings as signal lines per pixel, so that a pixel configuration becomes complicated. Meanwhile, in the case where any driving IC is not added, there still remains the problem that the length of a selection period for selecting one of signal lines becomes short, thereby causing a trouble to occur in writing of display data signals into pixels, so that the quality of a displayed image is degraded.

SUMMARY

An advantage of some aspects of the invention is to provide an electro-optic device, a driving method for an electro-optic device and an electronic device including the electro-optic device, which perform switching between a regular speed driving operation and a double speed driving operation so as to enable suppression of the degradation of the quality of a displayed image without complicating a pixel configuration and increasing manufacturing cost.

An electro-optic device according to an aspect of the invention includes a plurality of scanning lines; a plurality of signal lines; a plurality of pixels each provided so as to correspond to one of intersections of the plurality of scanning lines and the plurality of signal lines; a scanning line driving portion configured to perform scanning line driving operations each for selecting at least one of the scanning lines at a corresponding timing point in accordance with a vertical scanning frequency; a signal line driving portion configured to supply the pixels, via the signal lines, with image signals each including at least time-division multiplexed data voltages each having a magnitude equivalent to a gray-scale level with which display is to be performed; a signal line selection portion configured to perform signal line selection operations in accordance with a control signal, each for selecting at least one signal line which is included in the signal lines, and through each of which a corresponding one of the image signals is supplied; and a controller configured to perform control so as to cause the vertical scanning frequency to be switched to any one of a first frequency and a second frequency which is higher than the first frequency, and the controller is configured to, in a state subsequent to switching of the vertical scanning frequency to the first frequency, output the control signal so as to, after an end of a first selection period for selecting at least one of the signal lines, cause any other at least one of the signal lines to be selected, and, in a state subsequent to switching of the vertical scanning frequency to the second frequency, output the control signal so as to, during a second selection period for selecting at least one of the signal lines, cause any other at least one of the signal lines to be selected, and thereby cause an overlapping period to arise during part of the second selection period for selecting at least one of the signal lines.

According to this first aspect, a scanning line driving signal is supplied to each of the at least one of the scanning lines by the scanning line driving portion, and the image signals each including at least time-division multiplexed data voltages each having a magnitude equivalent to a gray-scale level with which display is to be performed are supplied to corresponding ones of the pixels via the each of the at least one of the signal lines. In this case, the at least one of the signal lines, via each of which a corresponding one of the image signals is supplied, is selected by the signal line selection portion, and the controller is configured to, in a state subsequent to switching of the vertical scanning frequency to the first frequency, output the control signal so as to, after an end of a first selection period for selecting at least one of the signal lines, cause any other at least one of the signal lines to be selected. Accordingly, in each of pixels corresponding to the any other at least one of the signal lines, display of high image quality is performed without being affected by electric potentials of pixels corresponding to the at least one of the signal lines which is selected during the first selection period. Further, the controller is configured to, in a state subsequent to switching of the vertical scanning frequency to the second frequency, output the control signal so as to, during a second selection period for selecting at least one of the signal lines, cause any other at least one of the signal lines to be selected, and thereby cause an overlapping period to arise during part of the second selection period for selecting at least one of the signal lines. Accordingly, even when the length of data-voltage writing time per pixel becomes short, an overlapping period arises during part of the second selection period for selecting at least one of the signal lines, and thus, it becomes possible to sufficiently ensure data-voltage writing time for corresponding ones of the pixels, and this results in the improvement of the quality of a displayed image.

In the aforementioned electro-optic device according to the first aspect, the signal line driving portion may be configured to, at intervals of one vertical scanning period, reverse a polarity of each of the image signals relative to a reference electric potential value for the pixels. In the case where, concurrently with such a driving operation as described above, switching of the vertical scanning frequency to the second frequency which is higher than the first frequency is performed, the length of data-voltage writing time per pixel becomes short, but an overlapping period arises during part of the second selection period for selecting at least one of the signal lines, and thus, it becomes possible to sufficiently ensure data-voltage writing time for corresponding ones of the pixels, and this results in the improvement of the quality of a displayed image.

In the aforementioned electro-optic device according to the first aspect, the signal line driving portion may be configured to, under control from the controller, be switched to any one of a three-dimensional view image driving operation, in which the image signals for a right-eye image and the image signals for a left-eye image are alternately supplied at intervals of a display period, and a two-dimensional view image driving operation, in which the image signals for images common to a right eye and a left eye are supplied, and the controller may be configured to, when causing the signal line driving portion to be switched into the two-dimensional view image driving operation, perform control so as to cause the vertical scanning frequency to be switched to the first frequency, and when causing the signal line driving portion to be switched into the three-dimensional view image driving operation, perform control so as to cause the vertical scanning frequency to be switched to the second frequency.

According to this configuration, the controller is configured to, when causing the signal line driving portion to be switched into the two-dimensional view image driving operation, perform control so as to cause the vertical scanning frequency to be switched to the first frequency, and output the control signal so as to, after an end of the first selection period for selecting at least one of the signal lines, cause any other at least one of the signal lines to be selected. Accordingly, in the case where two-dimensional view images are displayed, in each of pixels corresponding to the any other at least one of the signal lines, display of high image quality is performed without being affected by electric potentials of pixels corresponding to the at least one of the signal lines which is selected during the first selection period, and this results in display of a high image quality. Further, the controller is configured to, when causing the signal line driving portion to be switched to the two-dimensional view image driving operation, perform control so as to cause the vertical scanning frequency to be switched to the second frequency, and output the control signal so as to, during the second selection period for selecting at least one of the signal lines, cause any other at least one of the signal lines to be selected, and thereby cause an overlapping period to arise during part of the second selection period for selecting at least one of the signal line. Accordingly, even when the three-dimensional view image driving operation for allowing the image signals for a write-eye image and the image signals for a left-eye image to be alternately supplied is performed, and thereby the length of data-voltage writing time per pixel becomes short, an overlapping period arises during part of the second selection period for selecting at least one of the signal lines, and thus, it becomes possible to sufficiently ensure data-voltage writing time for corresponding ones of the pixels, and this results in the improvement of the quality of displayed images.

In the aforementioned electro-optic device according to the first aspect, a light source that is luminance-adjusted to at least a first luminance level and a second luminance level which is higher than the first luminance level, and a luminance detector that detects a luminance level under an installation environment where the electro-optic device according to the first aspect is installed may be further included, and in the case where a luminance level under the installation environment, which is detected by the luminance detector, is lower than a third luminance level which is a reference level, the controller may perform control so as to cause a luminance level of the light source to be switched to the first luminance level and cause the vertical scanning frequency to be switched to the first frequency, and in the case where the luminance level under the installation environment, which is detected by the luminance detector, is higher than or equal to the third luminance level, the controller may perform control so as to cause a luminance level of the light source to be switched to the second luminance level and cause the vertical scanning frequency to be switched to the second frequency.

According to this configuration, in the case where a luminance level under the installation environment, which is detected by the luminance detector, is lower than a third luminance level which is a reference level, the controller is configured to perform control so as to cause a luminance level of the light source to be switched to the first luminance level and cause the vertical scanning frequency to be switched to the first frequency, and output the control signal so as to, after an end of the first selection period for selecting at least one of the signal lines, cause any other at least one of the signal lines to be selected. Accordingly, in the case where the electro-optic device is installed at a relatively dark place, display of high image quality is performed without being affected by electric potentials of pixels corresponding to the at least one of the signal lines which is selected during the first selection period, and this results in display of a high image quality. Further, in the case where a luminance level under the installation environment, which is detected by the luminance detector, is higher than the third luminance level, the controller is configured to perform control so as to cause a luminance level of the light source to be switched to the second luminance level and cause the vertical scanning frequency to be switched to the second frequency, and output the control signal so as to, during the second selection period for selecting at least one of the signal lines, cause any other at least one of the signal lines to be selected, and thereby cause an overlapping period to arise during part of the second selection period for selecting at least one of the signal line. Accordingly, in the case where the electro-optic device is installed at a relatively light place, the vertical scanning frequency is switched to the second frequency in order to suppress the occurrence of flickering, so that the length of data-voltage writing time per pixel becomes short, but an overlapping period arises during part of the second selection period for selecting at least one of the signal lines, and thus, it becomes possible to sufficiently ensure data-voltage writing time for corresponding ones of the pixels, and this results in the improvement of the quality of displayed images.

In the aforementioned electro-optic device according to the first aspect, the signal line driving portion may be configured to, at least during a pre-charge period prior to operations for supplying the data voltages to the pixels, supply a pre-charge voltage such that the pre-charge voltage is supplied via at least one of the signal lines which is to be selected, and the controller may be configured to, during the pre-charge period, output the control signal so as to cause all the signal lines to be selected.

This configuration suppresses the influence of leakages from other pixels, and thus, makes it possible to suppress the unevenness of luminance as well as vertical crosstalk.

In the aforementioned electro-optic device according to the first aspect, the scanning line driving portion may be configured to, during the pre-charge period, supply each of the scanning lines with a scanning signal which causes corresponding ones of switching elements to be in an on-state.

This configuration suppresses the influence of leakages from other pixels, and thus, makes it possible to suppress the unevenness of luminance as well as vertical crosstalk.

In the aforementioned electro-optic device according to the first aspect, the controller may be configured to output the control signal so as to, during an overall period from a beginning of the pre-charge period until an end of a selection period for firstly selecting at least one of the signal lines within one horizontal scanning period, cause the firstly selected at least one of the signal lines to be selected.

This configuration suppresses the influence of leakages from other pixels due to the writing operation of the pre-charge voltage onto relevant ones of the signal lines, and thus, makes it possible to suppress the unevenness of luminance as well as vertical crosstalk and sufficiently ensure data-voltage writing time for each of the pixels, so that this results in the improvement of the quality of a displayed image.

In the aforementioned electro-optic device according to the first aspect, the signal line selection portion may be configured to, when needed, change order of the signal line selection operations each for selecting at least one of the signal lines in accordance with the control signal.

According to this configuration, with respect to signal lines which are previously selected and signal lines which are subsequently selected during the overlapping period, the influence of data voltages of pixels corresponding to the previously selected signal lines on pixels corresponding to the subsequently selected signal lines can be made even.

A control method for an electro-optic device, according to a second aspect of the invention, is for use in an electro-optic device provided with a plurality of scanning lines, a plurality of signal lines, and a plurality of pixels each provided so as to correspond to one of intersections of the plurality of scanning lines and the plurality of signal lines. Further, the control method includes performing scanning line driving operations each for selecting at least one of the scanning lines at a corresponding timing point in accordance with a vertical scanning frequency; supplying the pixels, via the signal lines, with image signals each including at least time-division multiplexed data voltages each having a magnitude equivalent to a gray-scale level with which display is to be performed; performing signal selection operations in accordance with a control signal, each for selecting at least one signal line which is included in the signal lines, and through each of which a corresponding one of the image signals is supplied; and performing control so as to cause the vertical scanning frequency to be switched to any one of a first frequency and a second frequency which is higher than the first frequency. Further, in a state subsequent to switching of the vertical scanning frequency to the first frequency, the control signal is outputted so as to, after an end of a first selection period for selecting at least one of the signal lines, cause any other at least one of the signal lines to be selected, and, in a state subsequent to switching of the vertical scanning frequency to the second frequency, the control signal is outputted so as to, during a second selection period for selecting at least one of the signal lines, cause any other at least one of the signal lines to be selected, and thereby cause an overlapping period to arise during part of the second selection period for selecting at least one of the signal lines.

Next, an electronic device according to a second aspect of the invention includes the aforementioned electro-optic device according to the first aspect of the invention.

In this kind of an electronic device, even when, in a display device, such as a liquid crystal display, data-voltage writing time per pixel becomes short because of higher resolution, since an overlapping period arises during part of a selection period for selecting at least one of the signal lines which is for use in writing of data voltages, it becomes possible to sufficiently ensure data-voltage writing time for each pixel, and this results in the improvement of the quality of a displayed image.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
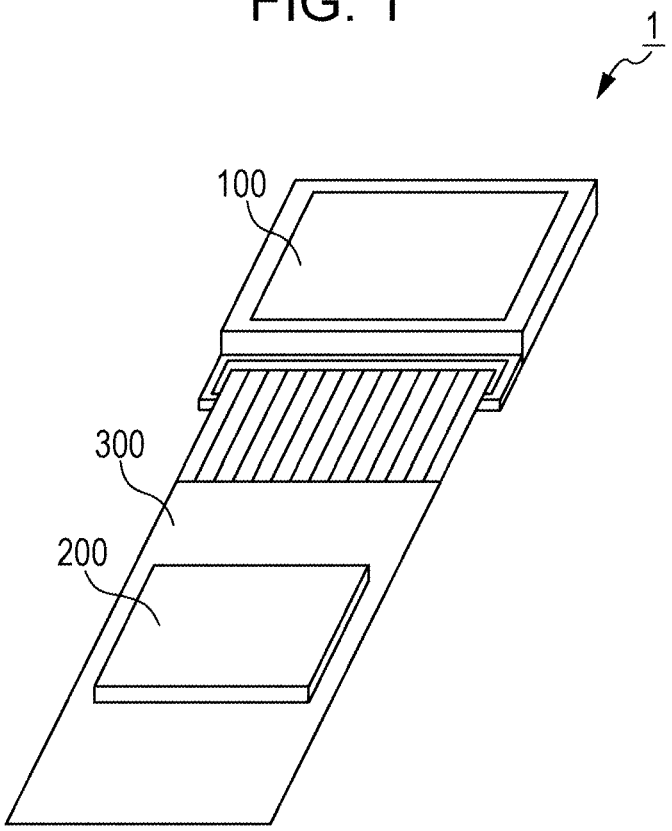
FIG. 1 is a diagram for describing an electro-optic device according to a first embodiment of the invention.

FIG. 1 is a diagram illustrating a configuration of a system for transmitting signals in an electro-optic device 1. As shown in FIG. 1, the electro-optic device 1 includes an electro-optic panel 100, a driving integrated circuit 200 and a flexible circuit substrate 300, and the electro-optic panel 100 is connected to the flexible circuit substrate 300 provided thereon with the driving integrated circuit 200. The electro-optic panel 100 is connected to a host CPU (not illustrated) via these flexible circuit substrate 300 and driving integrated circuit 200. Here, the driving integrated circuit 200 is a device which receives image signals as well as various control signals for use in driving control, from the host CPU via the flexible circuit substrate 300, and drives the electro-optic panel 100.

Figure 2:
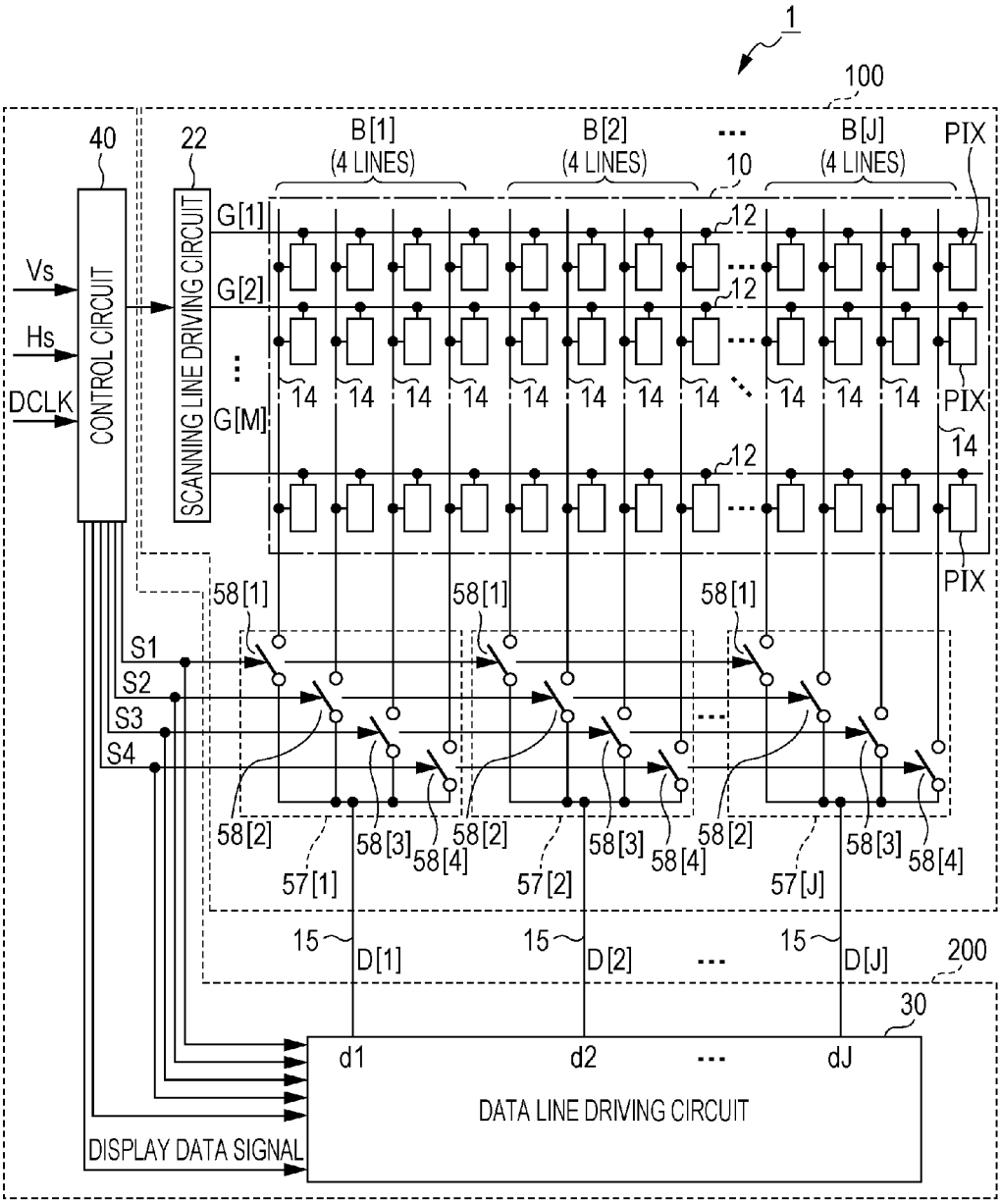
FIG. 2 is a block diagram illustrating a configuration of an electro-optic device according to the first embodiment.

FIG. 2 is a block diagram illustrating a configuration of the electro-optic panel 100 as well as a configuration of the driving integrated circuit 200. As shown in FIG. 2, the electro-optic panel 100 includes a pixel portion 10, a scanning line driving circuit 200 as the scanning line driving portion, and J demultiplexers 57[1] to 57[J] collectively as the signal line selecting portion. The driving integrated circuit 200 includes a data line driving circuit 30 as the signal line driving portion as well as a control circuit as the controller.

In the pixel portion 10, there are formed a group of M scanning lines 12 and a group of N signal lines 14, these two groups being intersected with each other. There is provided a plurality of pixel circuits PIX each associated with a corresponding one of intersections of the scanning lines 12 and the signals lines 14, and the pixel circuits PIX are arranged in a matrix shape of M rows arranged in a vertical direction and N columns arranged in a horizontal direction.

Figure 3:
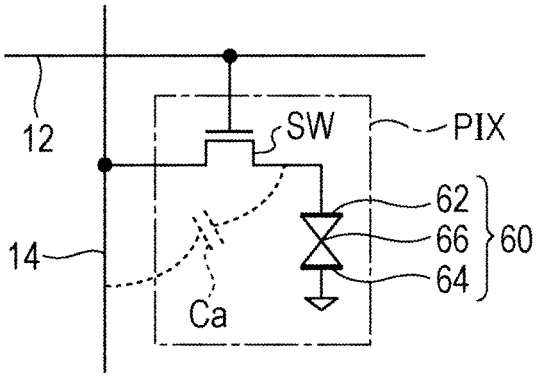
FIG. 3 is a circuit diagram illustrating a configuration of a pixel.

FIG. 3 is a circuit diagram of each pixel circuit PIX. As shown in FIG. 3, the each pixel circuit PIX includes a liquid crystal element 60 and a switching element SW, such as a TFT. This liquid crystal element 60 is an electro-optic element including a pixel electrode 62 and a common electrode 64 which are opposite to each other, as well as liquid crystal 66 interposed between the pixel electrode 62 and the common electrode 64. The transmittance (display gray-scale level) of the liquid crystal 66 varies in accordance the level of a voltage which is applied between the pixel electrode 62 and the common electrode 64. In addition, a configuration in which an auxiliary capacitor is connected in parallel with the liquid crystal element 60 can be employed. The switching element SW, which is constituted of, for example, an N channel type transistor whose gate is connected to one of the scanning lines 12, is arranged between the liquid crystal element 60 and one of the signal lines 14 and performs control of an electric connection (a conduction or a non-conduction) therebetween. When a scanning signal Y[m] is set to a selection electric potential, the switching elements SW each included in a corresponding one of the pixel circuits PIX of an m-th row simultaneously transit to ON state.

When one of the scanning lines 12 which is associated with a pixel circuit PIX is selected and the switching element SW of the pixel circuit PIX is controlled so as to transit to ON state, a voltage in accordance with an image signal D[n] which is supplied to the pixel circuit PIX from a corresponding one of the signal lines 14 is applied to the liquid element 60 of the pixel circuit PIX, so that the transmittance of the liquid crystal 66 of the pixel circuit PIX is set to a transmittance in accordance with the image signal D[n]. Further, when a light source (not illustrated) is brought into ON state (a lighting state) and a light ray is irradiated from the light source, the light ray transmits through the liquid crystal 66 included in the pixel circuit PIX and proceeds to an observer side. That is, when a voltage in accordance with the image signal D[n] is applied to the liquid crystal element 60, and further, the light source is brought into ON state, a pixel corresponding to the pixel circuit PIX results in display with a gray-scale level in accordance with the image signal D[n].

When the switching element SW is brought to ON state after an application of a voltage in accordance with the image signal D[n] to the liquid crystal element 60 of the pixel circuit PIX, ideally, the applied voltage in accordance with the image signal D[n] is retained. Thus, ideally, each pixel displays with a gray-scale level equivalent to the image signal D[n] during a period from a time point when the switching element SW has been brought to ON state until a time point the switching element SW is brought to ON state next.

As shown in FIG. 3, capacitance Ca is parasitized between the signal line 14 and the pixel electrode 62 (or between the signal line 14 and a wiring which electrically connects between the pixel electrode 62 and the switching element SW). Thus, there is a case where an electric potential variation of the signal line 14 is propagated to the pixel electrode 62 through the capacitance Ca, thereby causing a voltage being applied to the liquid element 60 to vary.

Further, the common electrode 64 is supplied with a common voltage LCCOM, which is a constant voltage, via a common line (not illustrated). As the common voltage LCCOM, a voltage of around −0.5 V is used when the central voltage of the image signal D[n] is made 0 V.

In this embodiment, in order to prevent the occurrence of so called image persistence, a polarity inversion driving method which causes the polarity of a voltage applied to the liquid crystal element 60 to be inverted at a predetermined cycle, for example, at intervals of one frame, is employed. In this embodiment, the voltage level of the image signal D[n] supplied to the pixel circuit PIX via the signal line 14 is inverted at intervals of unit period relative to the central voltage of the image signal D[n]. The unit period means a period corresponding to unit of operations for driving the pixel circuits PIX. In this embodiment, the unit period is a vertical scanning period, that is, one frame period. In addition, the unit period can be set to any desired period, and may be set to, for example, a period resulting from multiplying a vertical scanning period by a natural number. In this embodiment, the polarity of the image signal D[n] is made a positive polarity in the case where the voltage of the image signal D[n] is higher than the central voltage of the image signal D[n]; while the polarity of the image signal D[n] is made a negative polarity in the case where the voltage of the image signal D[n] is lower than the central voltage of the image signal D[n].

Here, the description is returned to FIG. 2. The control circuit 40 performs synchronization control of the scanning line driving circuit 22 and the data line driving circuit 30 on the basis of external signals inputted from an external device (not illustrated), such as a vertical synchronization signal Vs, a horizontal synchronization signal Hs and a dot clock signal DCLK. Under this synchronization control, the scanning driving circuit 22 and the data line driving circuit 30 perform display control of the pixel portion 10 in cooperation with each other.

The scanning driving circuit 22 outputs each of scanning signals G[1] to G[M] onto a corresponding one of the M scanning lines 12. The scanning line driving circuit 22 is configured to, for each horizontal scanning period H which is synchronized with an output of the horizontal synchronization signal Hs from the control circuit 40, sequentially cause a corresponding one of the scanning signals G[1] to G[M], each associated with a corresponding one of the scanning lines 12, to be in an active-level state.

Here, during a period when a scanning signal G[m] corresponding to an m-th row is in the active-level state and a scanning line corresponding to the m-th row is selected, switching elements SW each included in a corresponding one of N pixel circuits PIX of the m-th row are brought to ON state, and via these switching elements SW, each of the N signal lines 14 is connected to the pixel electrode 62 of a corresponding one of the N pixel circuits of the m-th row.

The N signal lines 14 inside the pixel portion 10 are sectioned into J wiring blocks B[1] to B[J] for every four mutually adjacent signal lines 14 (J being equal to N/4). The demultiplexers 57[1] to 57[J] are associated with these wiring blocks B[1] to B[J], respectively.

The demultiplexer 57[*j*] (j being any one of 1 to J) includes four switches 58[1] to 58[4]. In the demultiplexer 57[*j*] (j being any one of 1 to J), one of connection points of each of the four switches 58[1] to 58[4] is connected to a common connection point. Further, the common connection point of the one of connection points of each of the four switches 58[1] to 58[4] of the demultiplexer 57[*j*] (j being any one of 1 to J) is connected to a corresponding one of the J signal lines 15. These J signal lines 15 are connected to the data line driving circuit 30 of the driving integrated circuit 200 via the flexible circuit substrate 300. Further, in the demultiplexer 57[*j*] (j being any one of 1 to J), the other one of connection points of each of the four switches 58[1] to 58[4] is connected to a corresponding one of four signal lines 14 constituting a wiring block B[j] corresponding to the demultiplexer 57[*j*].

The ON/OFF of each of the four switches 58[1] to 58[4] of the demultiplexer 57[*j*] (j being any one of 1 to J) is switched by a corresponding one of four selection signals S1 to S4. These four selection signals S1 to S4 are supplied from the control circuit 40 of the driving integrated circuit 200 via the flexible circuit substrate 300. Here, when, for example, one selection signal S1 is in the active level state and the other three selection signals S2 to S4 are each in a non-active level state, only J switches 58[1] each belonging to a corresponding demultiplexer 57[*j*] (j being any one of 1 to J) are turned ON. Consequently, the demultiplexer 57[*j*] (j being any one of 1 to J) outputs a corresponding one of the image signals D[1] to D[J] existing on J signal lines 15 onto a 1st one of the four signal lines 14 of a corresponding one of the wiring blocks B[1] to B[J]. Subsequently, in the same way as described above, the demultiplexer 57[*j*] (j being any one of 1 to J) sequentially outputs a corresponding one of the image signals D[1] to D[J] existing on the J signal lines 15 onto a 2nd one, a 3rd one and a 4th one of the four signal lines 14 of a corresponding one of the wiring blocks B[1] to B[J].

The control circuit 40 includes a frame memory, and this frame memory includes therein at least a memory space of M×N bits corresponding to the resolution of the pixel portion 10, and stores and retains therein display data inputted from an external device in unit of one frame. Here, the display data, which defines the gray-scale levels of the display portion 10, is, for example, a set of pieces of data each being composed of 6 bits and representing 64 gray-scale levels. The display data having been read out from the frame memory is serially transferred to the data line driving circuit 30 via a 6-bit bus. In addition, this display data also includes pre-charge signals described below.

In addition, the control circuit 40 may be configured so as to include a line memory having a storage capacity enough to store therein at least one line of data. In this case, the control circuit 40 stores one line of display data in the line memory, and then, transfers the one line of display data to the individual pixels.

The data line driving circuit 30 outputs, for each pixel row targeted for data writing, pieces of data to be supplied, towards the data lines 14 in cooperation with the scanning line driving circuit 22. The data line driving circuit 30 generates latching signals on the basis of the selection signals S1 to S4 outputted from the control circuit 40, and sequentially latches N display data signals, which are supplied as serial data and each of which is composed of 6 bits, by using the latching signals. The display data signals are sequentially grouped, for each set of four pixels, into a group as time-series data. Further, in the data line driving circuit 30, digital-to-analog (D/A) conversion circuits are provided, and pieces of digital data having been grouped are D/A converted, and thereby, voltages as pieces of analog data are generated. Through this processing, the pre-charge signals are converted into predetermined pre-charge voltages Vpre, and the display data signals, which have been time-serialized in unit of four pixels, are also converted into predetermined data voltages. Further, a set of a pre-charge voltage and data voltages each for a corresponding one of four pixels is supplied, in this order, to each of the signal lines 15.

Each of the switches 58[1] to 58[4] of the demultiplexer 57[*j*] (j being any one of 1 to J) is conduction-controlled by a corresponding one of the selection signals S1 to S4 outputted from the control circuit 40, and is turned ON at a relevant timing point. Through this processing, in a horizontal scanning period (1H), the set of a pre-charge voltage and data voltages each for a corresponding one of four pixels is supplied to each of the signal lines 15, and then, is outputted, on a time-series basis, by one of the switches 58[1] to 58[4] onto corresponding ones of the signal lines 14.

The above is a configuration of the electro-optic device 1.

Figure 4:
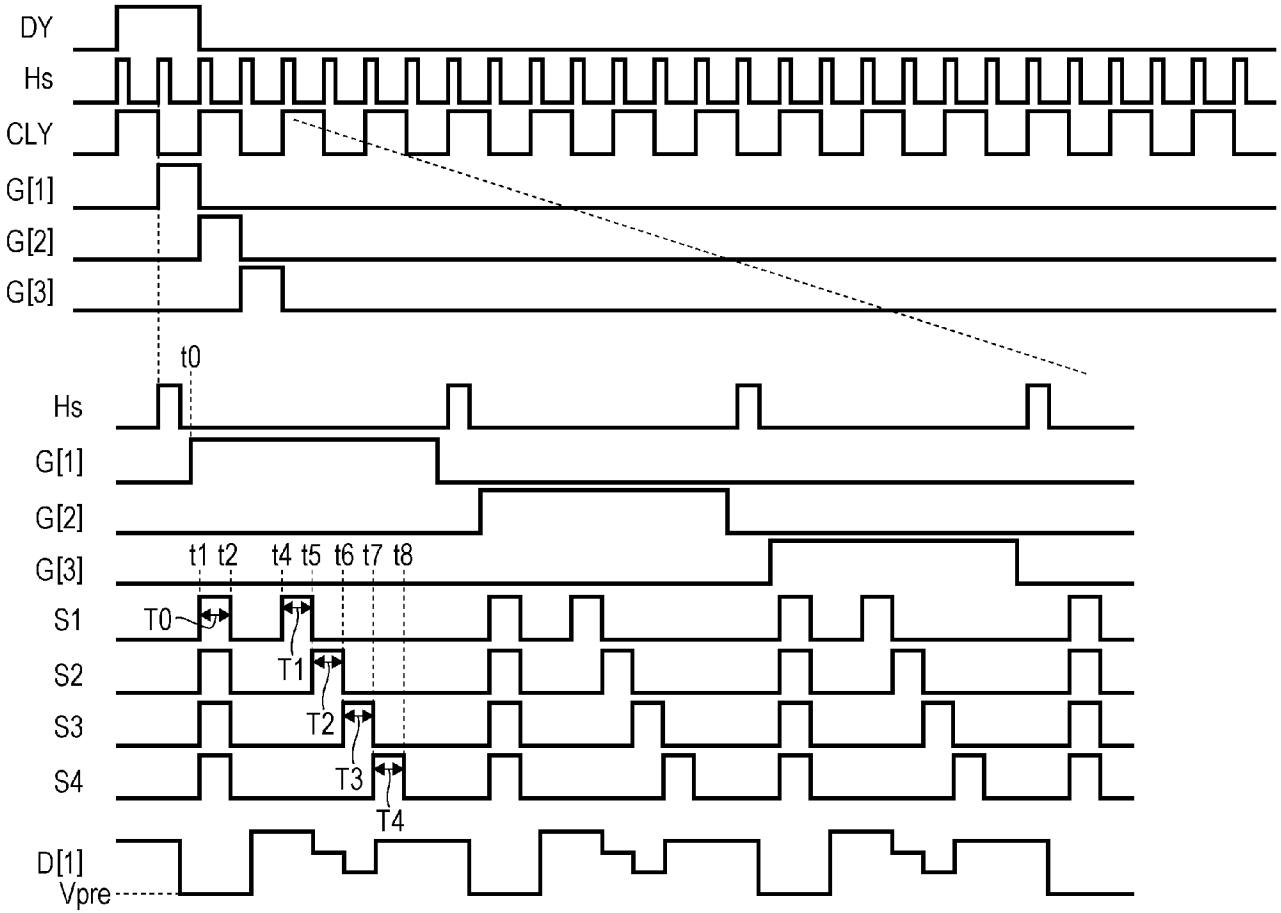
FIG. 4 is a timing chart illustrating operation of an electro-optic device according to the first embodiment.

In FIG. 4, there is illustrated a timing chart for the driving integrated circuit 200. Upon input of the horizontal synchronization signal Hs from an external device to the control circuit 40, the control circuit 40 drives the scanning line driving circuit 22 in synchronization with the horizontal synchronization signal Hs. The scanning line driving circuit 22 generates each of scanning signals G[1], G[2], . . . , and G[n] by sequentially shifting a signal corresponding to a transfer start pulse DY having a cycle of one frame (1F) in synchronization with a Y clock signal CLY. Each of the scanning signals G[1], G[2], . . . , and G[n] serially becomes in an active state. The data line driving circuit 30 generates sampling pulses SP 1, SP 2, . . . , and SP z (not illustrated) on the basis of an X transfer start pulse DX (not illustrated) having a cycle of one horizontal scanning period and an X clock signal CLX (not illustrated). Further, the data line driving circuit 30 generates the image signals D[1] to D[j] by sampling image signals VID 1 to VID j (not illustrated) by using the sampling pulses SP 1, SP 2, . . . , and SP z (not illustrated).

In addition, in the case of the 2D display, the control circuit 40 causes each of the scanning driving circuit 22 and the data line driving circuit 30 to drive by switching a frame frequency to 120 Hz which is the first frequency; while, in the case of the 3D display, the control circuit 40 causes each of the scanning driving circuit 22 and the data line driving circuit 30 to drive by switching a frame frequency to 240 Hz which is the second frequency.

The control circuit 40 outputs the each of the selection signals S1 to S4 to the data line driving circuit 30 and a corresponding one of the four switches 58[1] to 58[4] of each of the demultiplexers 57[*j*] (j being 1 to J) in synchronization with the horizontal synchronization signal Hs. The data line driving circuit 30 outputs each of the images D[1] to D[j] to a corresponding one of the signal lines 15 from a corresponding one of output terminals d1 to dj. The four switches 58[1] to 58[4] of each of the demultiplexers 57[*j*] (j being 1 to J) are each turned ON/OFF on the basis of a corresponding one of the selection signals S1 to S4, and thereby, the image signals D[1] to D[j] each including the pre-charge signal are each outputted to corresponding ones of the signal lines 14.

In this embodiment, a configuration is made such that a method for driving the selection signals S1 to S4 is switched depending on which of a 2D display and a 3D display is performed. Hereinafter, a method for driving the selection signals in the case where the 2D display is performed as well as a method for driving the selection signals in the case where the 3D display is performed will be described in more detail.

In Case of 2D Display

First, a method for driving the selection signals in the case where a 2D display is performed will be described. As shown in FIG. 4, the control circuit 40 simultaneously causes the selection signals S1 to S4 to be in an active state during a period T0 from a timing point t0 when the scanning signal G[1] becomes in the active state until a timing point t1 after an elapse of a predetermined period, and continuously keeps the active state during the period T0. During the period T0, the image signals D[1] to D[j] are each set to the pre-charge voltage Vpre, and thus, the pre-charge voltage Vpre is written onto each of the signal lines 14, so that it is written into each of corresponding ones of the pixels.

After having caused each of the selection signals S1 to S4 to be in a non-active state, the control circuit 40 causes the selection signal S1 to be in the active state at a timing point t4 after an elapse of a predetermined period of time, and causes the selection signals S1 to be in the non-active state at a timing point t5 after an elapse of a period T1.

The control circuit 40 causes the selection signal S1 to be in the non-active state at the timing point t5, and simultaneously therewith, causes the selection signal S2 to be in the active state. Further, the control circuit causes the selection signal S2 to be in the non-active state at a timing point t6 after an elapse of a period T2.

The control circuit 40 causes the selection signal S2 to be in the non-active state at the timing point t6, and simultaneously therewith, causes the selection signal S3 to be in the active state. Further, the control circuit 40 causes the selection signal S3 to be in the non-active state at a timing point t7 after an elapse of a period T3.

The control circuit 40 causes the selection signal S3 to be in the non-active state at the timing point t7, and simultaneously therewith, causes the selection signal S4 to be in the active state. Further, the control circuit causes the selection signal S4 to be in the non-active state at a timing point t8 after an elapse of a period T4.

As described above, in the case of the 2D display in which the frame frequency is set to 120 Hz, each of the selection signals S1 to S4 is driven such that a period during which the each of the selection signals S1 to S4 is in the active state is not overlapped by a period during which any other one of the selection signals S1 to S4 is in the active state, and thus, pixels corresponding to selected ones of the signal lines 14, which are temporally subsequently supplied with their respective corresponding image signals are not affected by the electric potentials of pixels corresponding to other ones of the signal lines 14, which are temporally previously supplied with their respective corresponding image signals, so that a high-quality display is achieved.

In Case of 3D Display

Figure 5:
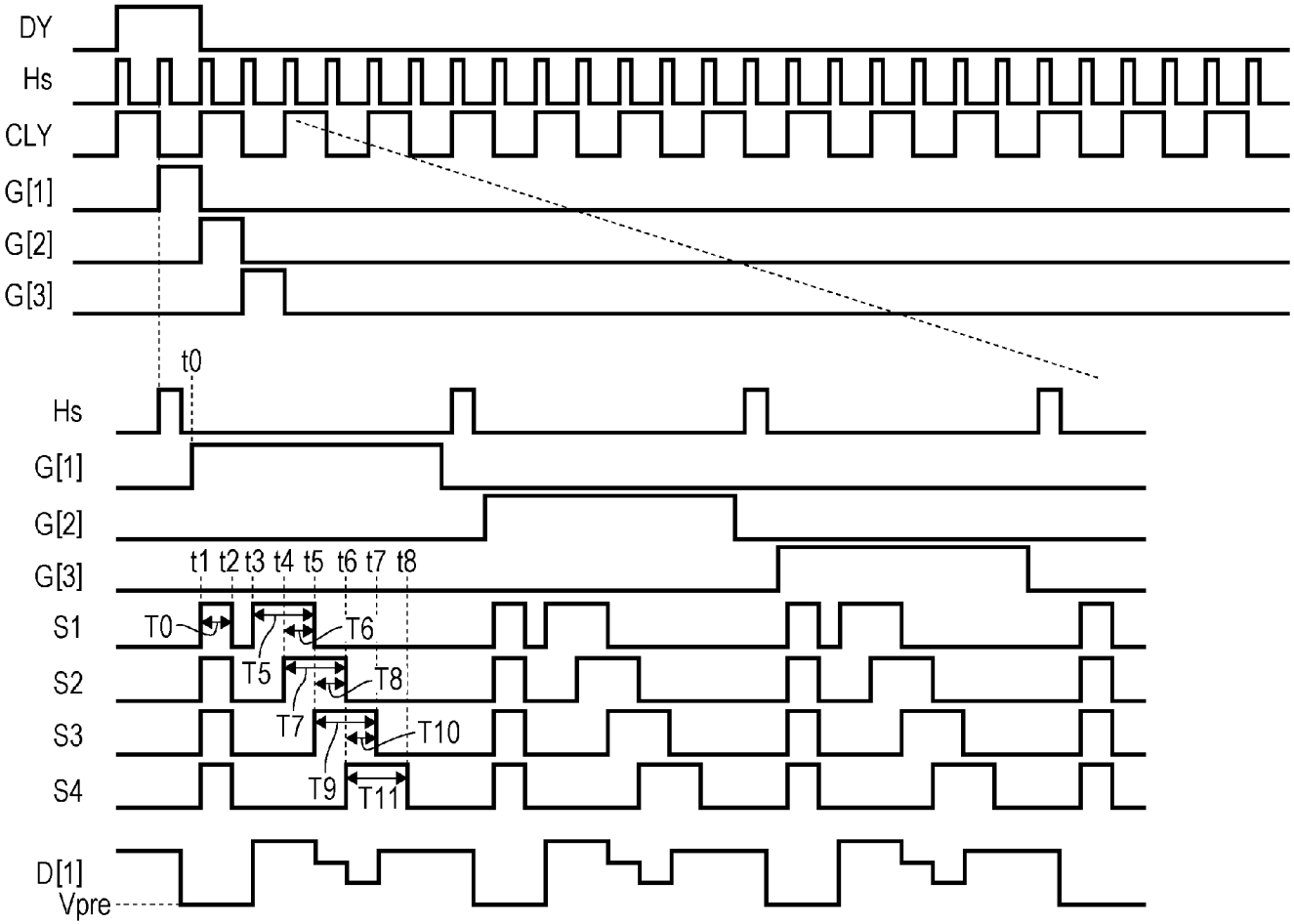
FIG. 5 is a timing chart illustrating operation of an electro-optic device according to the first embodiment.

Next, a method for driving the selection signals in the case where a 3D display is performed will be described. As shown in FIG. 5, the control circuit 40 simultaneously causes the selection signals S1 to S4 to be in the active state during a period T0 from a timing point t0 when the scanning signal G[1] becomes in the active state until a timing point t1 after an elapse of a predetermined period, and continuously keeps the active state during the period T0. During the period T0, the image signals D[1] to D[j] are each set to the pre-charge voltage Vpre, and thus, the pre-charge voltage Vpre is written onto each of the signal lines 14, so that it is written into each of corresponding ones of the pixels.

After having caused each of the selection signals S1 to S4 to be in the non-active state, the control circuit 40 causes the selection signal S1 to be in the active state at a timing point t3 after an elapse of a predetermined period. In the case of the 2D display, as shown FIG. 4, the control circuit 40 causes the selection signals S1 to be in the active state at the timing point t4 posterior to the timing point t3; while, in the case of the 3D display, the control circuit 40 causes the selection signals S1 to be in the active state at the timing point t3 anterior to the timing point t4. As a result, a period during which the selection signal S1 becomes in the active state is longer than the period T1, shown in FIG. 4, in the case of the 2D display, and becomes a period T5 shown in FIG. 5.

Similarly, the control circuit 40 causes the selection signal S1 to be in the non-active state at the timing point t5, and causes the selection signal S2 to be in the active state at the timing point t4 which is anterior to the timing point t5 by a predetermined period of time. In the case of the 2D display, as shown FIG. 4, the control circuit 40 causes the selection signal S2 to be in the active state at the timing point t5 posterior to the timing point t4; while, in the case of the 3D display, the control circuit 40 causes the selection signal S2 to be in the active state at the timing point t4 anterior to the timing point t5. As a result, a period during which the selection signal S2 becomes in the active state is longer than the period T2, shown in FIG. 4, in the case of the 2D display, and becomes a period T7 shown in FIG. 5. Further, the selection signal S1 and the selection signal S2 are controlled in this way, so that there occurs an overlapping period in which both of the selection signal S1 and the selection signal S2 are in the active state.

Hereinafter, similarly, the control circuit 40 causes the selection signal S3 to be in the active state at the timing point t5, and thus, a period during which the selection signal S3 becomes in the active state is longer than the period T3, shown in FIG. 4, in the case of the 2D display, and becomes a period T9 shown in FIG. 5. As a result, there occurs an overlapping period T8 during which both the selection signal S2 and the selection signal S3 become in the active state. Further, the control circuit 40 causes the selection signal S4 to be in the active state at the timing point t6, and thus, a period during which the selection signal S4 becomes in the active state is longer than the period T4, shown in FIG. 4, in the case of the 2D display, and becomes a period T11 shown in FIG. 5. As a result, there occurs an overlapping period T10 during which both the selection signal S3 and the selection signal S4 each become in the active state.

As described above, in this embodiment, in the case of the 3D display, the length of a period during which any one of the signal lines 14 is selected is made longer than in the case of existing methods, and further, the selection signals are driven such that an overlapping period in which two or more ones of the signal lines 14 are simultaneously selected is provided, and thus, even when, in order to perform the 3D display, the frame frequency is changed to 240 Hz which is double the 120 Hz, it is possible to sufficiently ensure a period of time during which any one of the pixels is supplied with a corresponding image signal, without providing any additional data line driving circuit. As a result, in the electro-optic panel 100, it is possible to improve the quality of a displayed image.

Second Embodiment

In the first embodiment, there has been described an example in which a method for driving the selection signals is switched depending on which of the 2D display and the 3D display is performed, and this embodiment is different from the first embodiment in the respect that the method for driving the selection signals is switched in accordance with the brightness in a room.

Figure 6:
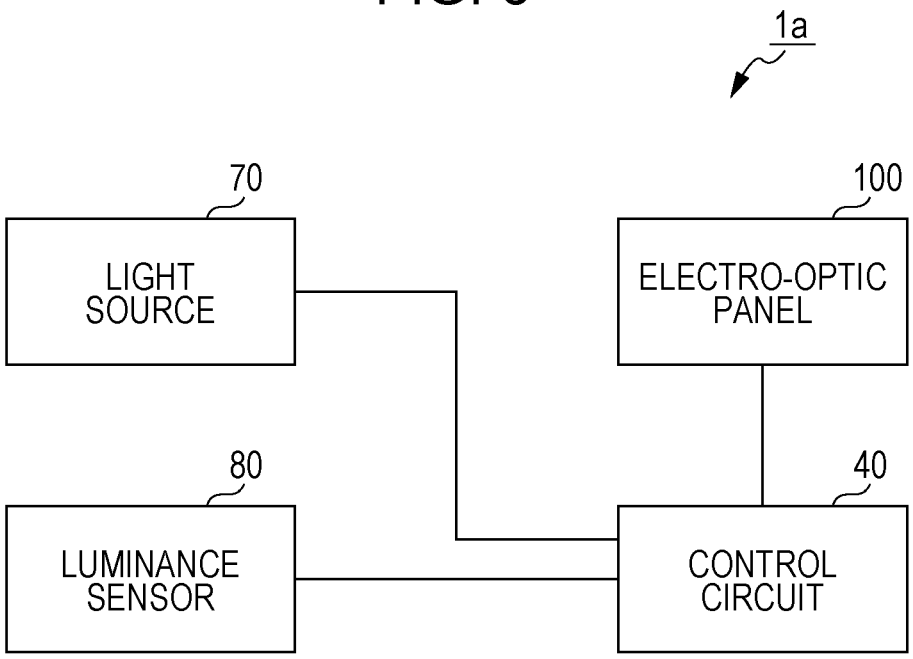
FIG. 6 is a block diagram illustrating a configuration of an electro-optic device according to a second embodiment of the invention.

FIG. 6 is a block diagram illustrating an electro-optic device of this embodiment. As shown in FIG. 6, an electro-optic device 1*a* of this embodiment includes a light source 70 and a luminance sensor 80 besides the electro-optic panel 100 and the control circuit 40. The light source 70 is a light source of the electro-optic panel 100, and is configured such that the luminance level of the light source 70 itself can be adjusted by the control circuit 40. The luminance sensor 80 is a sensor for detecting a luminance level in a room in which the electro-optic device 1*a* is installed.

The control circuit 40 is configured so as to increase the luminance level of the light source 70 in the case where an in-room luminance level detected by the luminance sensor 80 is determined to be larger than or equal to a predetermined value. Further, the control circuit 40 is configured so as to reduce the luminance of the light source 70 in the case where an in-room luminance level detected by the luminance sensor 80 is determined to be smaller than the predetermined value. Moreover, the control circuit 40 is configured so as to switch a frame frequency from 120 Hz to 240 Hz when increasing the luminance level of the light source 70, and switch the frame frequency from 240 Hz to 120 Hz when reducing the luminance level of the light source 70. This is because flickering is likely to become highly visible when the inside of a room becomes light.

In this embodiment, the control circuit 40 is configured to, when switching a frame frequency from 120 Hz to 240 Hz, select a method for driving the selection signals which allows occurrence of an overlapping period during a period when each of the selection signals S1 to S4 becomes in the active state, as shown in FIG. 5; while, when switching the frame frequency from 120 Hz to 240 Hz, select a method for driving the selection signals which does not allow any occurrence of an overlapping period during a period when each of the selection signals S1 to S4 becomes in the active state, as shown in FIG. 4.

According to this embodiment, in the case where a luminance level in a room is determined to be smaller than a predetermined value, the luminance level of the light source 70 is reduced, and further, the frame frequency is set to 120 Hz. In this case, each of the selection signals S1 to S4 is driven such that a period during which the each of the selection signals S1 to S4 is in the active state is not overlapped by a period during which any other one of the selection signals S1 to S4 is in the active state, and thus, relevant pixels corresponding to selected ones of the signal lines 14, which are temporally subsequently supplied with their respective corresponding image signals, are not affected by the electric potentials of pixels corresponding to other ones of the signal lines 14, which are temporally previously supplied with their respective corresponding image signals, so that a high-quality display is achieved.

Meanwhile, in the case where the luminance level in a room is determined to be larger than or equal to the predetermined value, the luminance of the light source 70 is increased, and further, the frame frequency is set to 240 Hz. In this case, a period during which one of the signal lines 14 is selected is made longer than in the case of existing methods, and the selection signals are driven such that an overlapping period in which two or more ones of the signal lines 14 are simultaneously selected is provided, and thus, even when the frame frequency is made 240 Hz which is double the 120 Hz, it is possible to sufficiently ensure a period of time during which a pixel is supplied with a corresponding image signal, without providing any additional data line driving circuit. As a result, in the electro-optic panel 100, it is possible to improve the quality of a displayed image.

Third Embodiment

Figure 7:
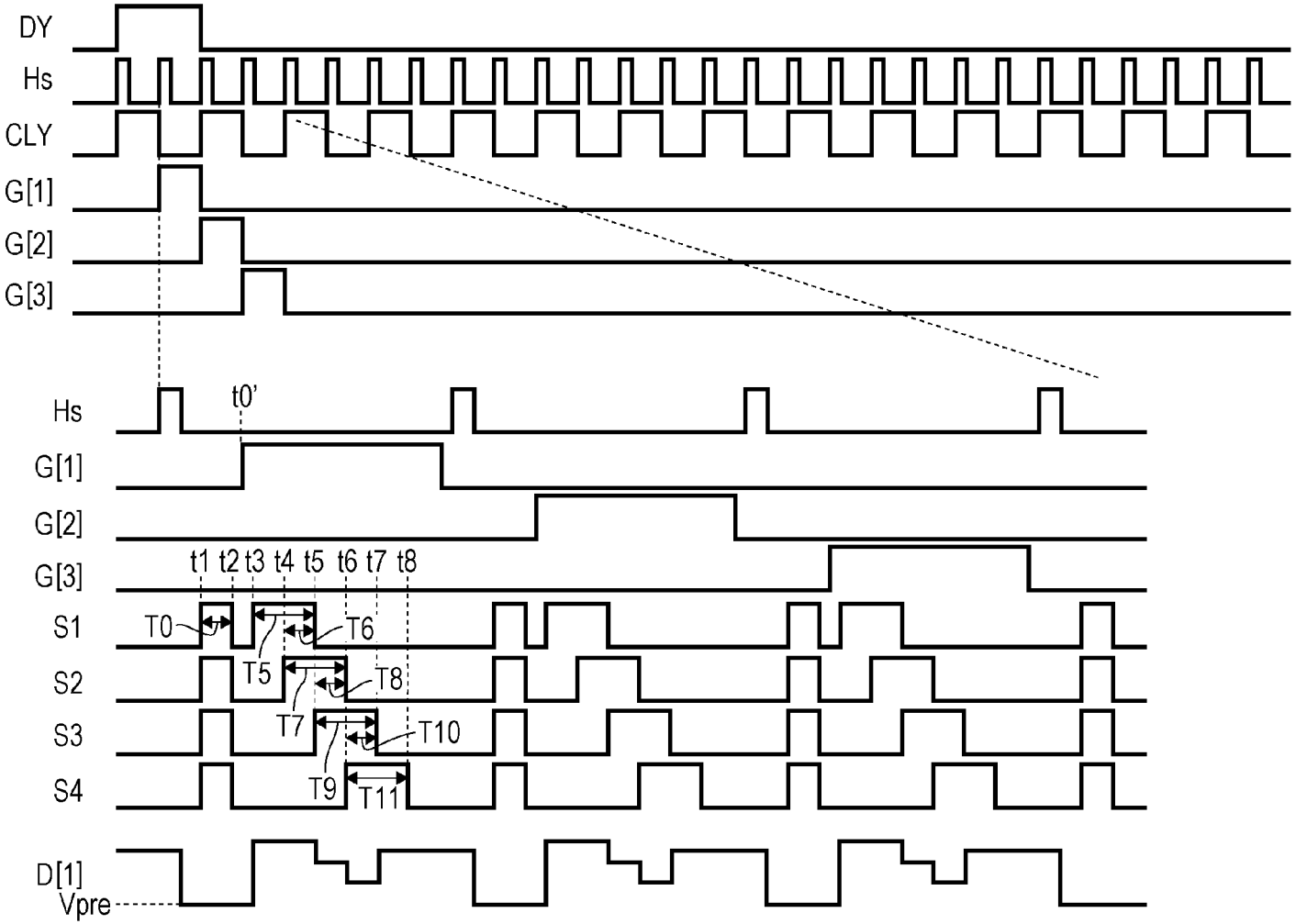
FIG. 7 is a timing chart illustrating operation of an electro-optic device according to a third embodiment of the invention.

In the first embodiment, there has been described an example in which each of the scanning signals G[1], G[2], . . . , and G[n] is caused to be in the active state at the timing point t0 slightly before the timing point t1 when the pre-charge signal is applied. In this embodiment, however, as shown in FIG. 7, when the pre-charge signal is applied, each of the scanning signals G[1], G[2], . . . , and G[n] remains in the non-active state, and becomes in the active state at a timing point t0' slightly before the timing point t3 when a first one of the selection signals is caused to be in the active state.

The purpose of applying the pre-charge signal is to suppress display unevenness due to the influence of leaks onto a relevant one of the signal lines 14 from pixel transistors each in an OFF state, and thus, even when each of the scanning signals G[1], G[2], . . . , and G[n] is caused to be in the OFF state at the time of applying the pre-charge signal, it is possible to suppress the leaks from the pixel transistors.

In this embodiment, since, after each of the scanning signals G[1], G[2], . . . , and G[n] is caused to be in the active state at the timing point t0', the length of a period during which one of the signal lines 14 is selected is made longer than in the case of existing methods, and further, the selection signals are driven such that an overlapping period in which two or more ones of the signal lines 14 are simultaneously selected is provided, even when the resolution of the electro-optic panel 100 is made high, it is possible to sufficiently ensure a period of time during which a pixel voltage is applied to a corresponding pixel without additionally providing a data line driving circuit. As a result, in the electro-optic panel 100, it is possible to improve the quality of a displayed image.

Fourth Embodiment

Figure 8:
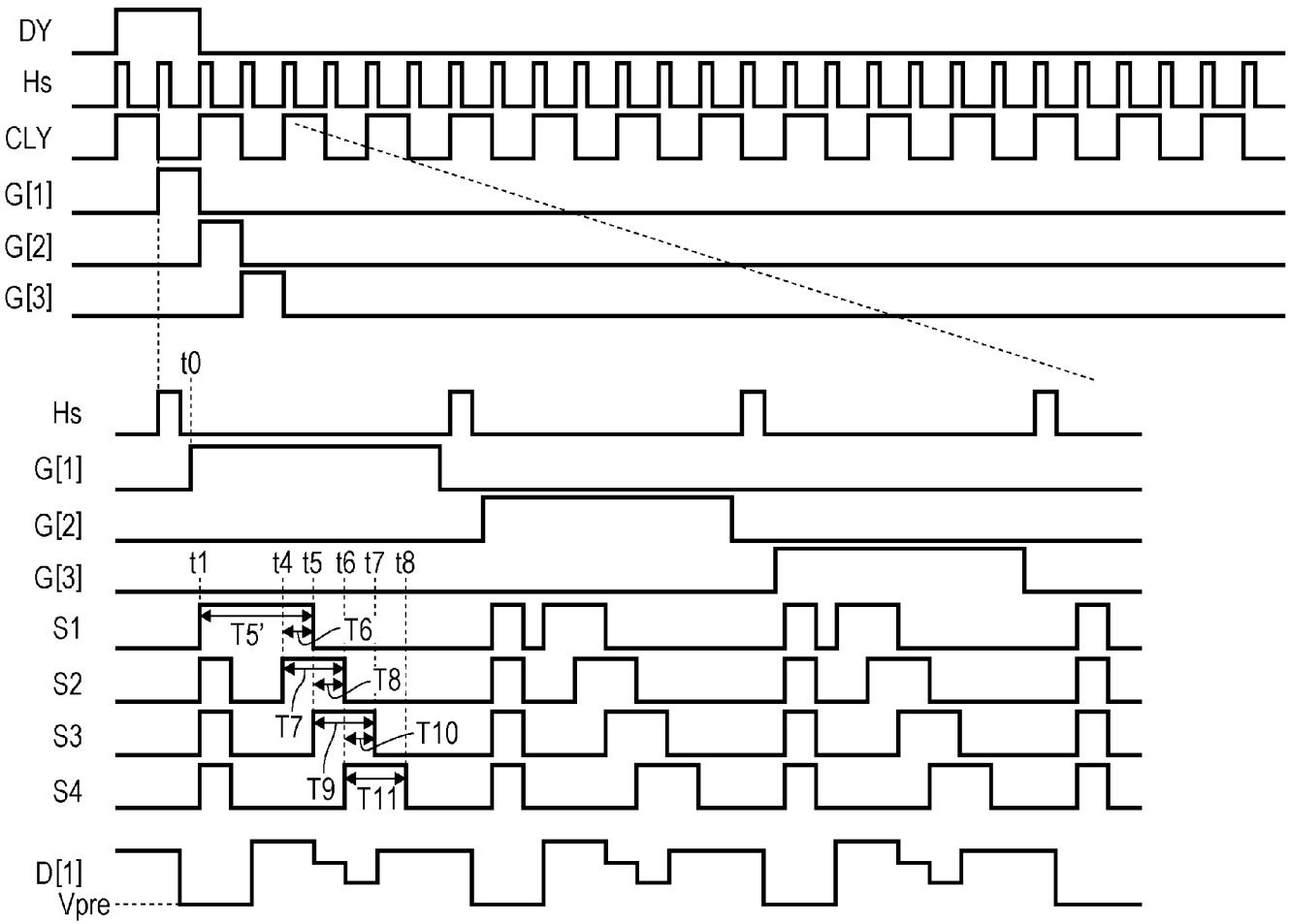
FIG. 8 is a timing chart illustrating operation of an electro-optic device according to a fourth embodiment of the invention.

In the first embodiment, there has been described an example in which the selection signals S1, S2, S3 and S4 are caused to be in the active state for the purpose of applying the pre-charge signal, and then, after the selection signal S1 is caused to be in the non-active state once, the selection signal S1 is caused to be in the active state at the timing point t3 for the purpose of applying image signals. In this embodiment, as shown in FIG. 8, the selection signals S1, S2, S3 and S4 are caused to be in the active state for the purpose of applying the pre-charge signal, and then, under the state where the active state of the selection signal S1 continues as it is, the selection signal is caused to be in the non-active state at a timing point t5.

According to this embodiment, since the active state of the selection signal S1 continues from the beginning of the applying the pre-charge signal until the completion of selecting the selection signal S1 to be selected first, and thus, the length of a period T5' during which the selection signal S1 becomes in the active state is longer than in the case of the first embodiment. As a result, it becomes possible to apply the pre-charge signal with certainty, and further, sufficiently ensure a period of time during which a pixel voltage is applied to a corresponding pixel, so that it becomes possible to improve the quality of a displayed image in the electro-optic panel 100.

Modification Example

The invention is not limited to the aforementioned embodiments, and can be subjected to various modifications, such as modifications described below. Further, naturally, the features of the aforementioned embodiments and the features of modification examples described below may be appropriately combined with one another.

Figure 9:
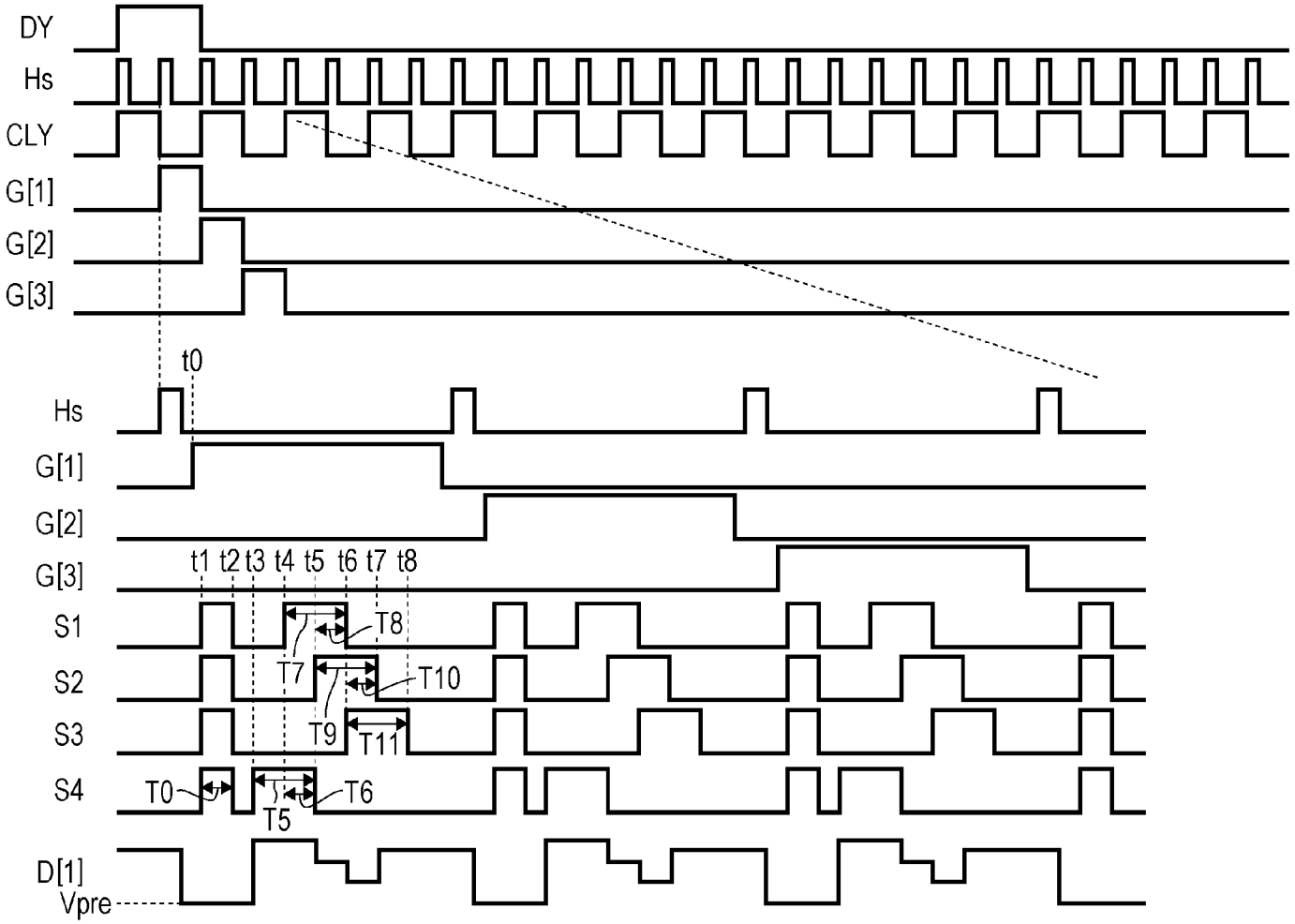
FIG. 9 is a timing chart illustrating operation of an electro-optic device according to a modification example.

(1) In each of the aforementioned embodiments, there has been described an example in which, first, the selection signal S1 is caused to be in the active state, and then, the selection signals S2, S3 and S4 are sequentially caused to be in the active state in this order, but the invention is not limited this example. For example, as shown in FIG. 9, first, the selection signal S4 may be in the active state, and then, the selection signals S1, S2 and S3 may be sequentially caused to be in the active state in this order. In this case, an overlapping period between the selection signal S4 and the selection signal S1 becomes T6, an overlapping period between the selection signal S1 and the selection signal S2 becomes T8, and an overlapping period between the selection signal S2 and the selection signal S3 becomes T10. In such a configuration as described above, it is also possible to make a period during which one of the signal lines 14 is selected longer than in existing methods, and further, it is possible to drive the selection signals so as to provide overlapping periods in each of which two or more ones of the signal lines 14 are simultaneously selected. In addition, each of the selection signals may be caused to be in the active state in any order as needed.

Further, order in which each of the selection signals is caused to be in the active state may be changed at intervals of one 1H period, or may be changed at intervals of one 1V period. Further, a combination which allows the order to change at intervals of one 1H period and, concurrently therewith, change at intervals of one 1V period may be employed. An example of the order change in this case is such that: S1, S2, S3 and S4 in a 1st 1H period; S2, S3, S4 and S1 in a 2nd 1H period; S3, S4, S1 and S2 in a 3rd 1H period; and S4, S1, S2 and S3 in a 4th 1H period, these changes being repeated in each of subsequent horizontal scanning periods including a 5th 1H period.

Further, in each of the aforementioned embodiments, there has been described an example in which the N signal lines 14 are sectioned into the J wiring blocks B[1] to B[J] for every mutually adjacent four ones of the signal lines 14, but each of the wiring blocks may not be composed of the mutually adjacent four ones of the signal lines 14, and may be composed of, for example, mutually adjacent two, three, five, six, seven, eight, . . . , or n ones of the signal lines (n being a natural number).

Further, in each of the aforementioned embodiments, there has been described an example in which the frame frequency is equal to the horizontal scanning frequency, but in the case where a sub-field driving operation for, in each of a plurality of sub-fields, performing a display with a corresponding gray-scale level, or the like, is performed, the frame frequency becomes lower than the horizontal scanning frequency.

Further, order in which each of the selection signals is caused to be in the active state may be changed at intervals of one horizontal scanning period, or may be changed at intervals of one vertical scanning period. Further, a combination which allows the order to change at intervals of one horizontal scanning period and, concurrently therewith, change at intervals of one vertical scanning period may be employed. An example of the order change is as follows. That is, the selection signals are caused to be in the active state in order of the selection signals, such as S1, S2, S3 and S4 in a first horizontal scanning period; S2, S3, S4 and S1 in a second horizontal scanning period; S3, S4, S1 and S2 in a third horizontal scanning period; and S4, S1, S2 and S3 in a fourth horizontal scanning period, and these changes of order are repeated in each of subsequent horizontal scanning periods including a fifth horizontal scanning period.

(2) In each of the aforementioned embodiments, there has been described an example in which the N signal lines 14 are sectioned into the J wiring blocks B[1] to B[J] for every mutually adjacent four ones of the signal lines 14, but each of the wiring blocks may not be composed of the mutually adjacent four ones of the signal lines 14, and may be composed of, for example, mutually adjacent two, three, five, six, seven, eight, . . . , or n ones of the signal lines (n being a natural number).

(3) In each of the aforementioned embodiments, liquid crystal have been given as an example of an electro-optic material, but the invention can be applied to any electro-optic device employing an electro-optic material other than the liquid crystal. This electro-optic material is a material whose optic characteristics, such as transmittance and luminance, vary in response to the supply of an electric signal (an electric-current signal or a voltage signal). The invention can be applied to, in the same ways as having been described in the aforementioned embodiments, various electro-optic devices, such as a display panel employing a light emitting element, such as an organic electroluminescent (EL) element, an inorganic EL element or a light emitting polymer element; an electrophoretic display panel employing, as electro-optic materials, microcapsules each containing colored liquid and white-color particles dispersed in the liquid; a twist-ball display panel employing, as electro-optic materials, twist balls each being applied to one of colors which are different in accordance with regions among which polarities are mutually different; a black-color toner display panel employing black-color toner as an electro-optic material; and a plasma display panel employing, as an electro-optic material, high-pressure gas, such as helium or neon.

Application Example

Figure 10:
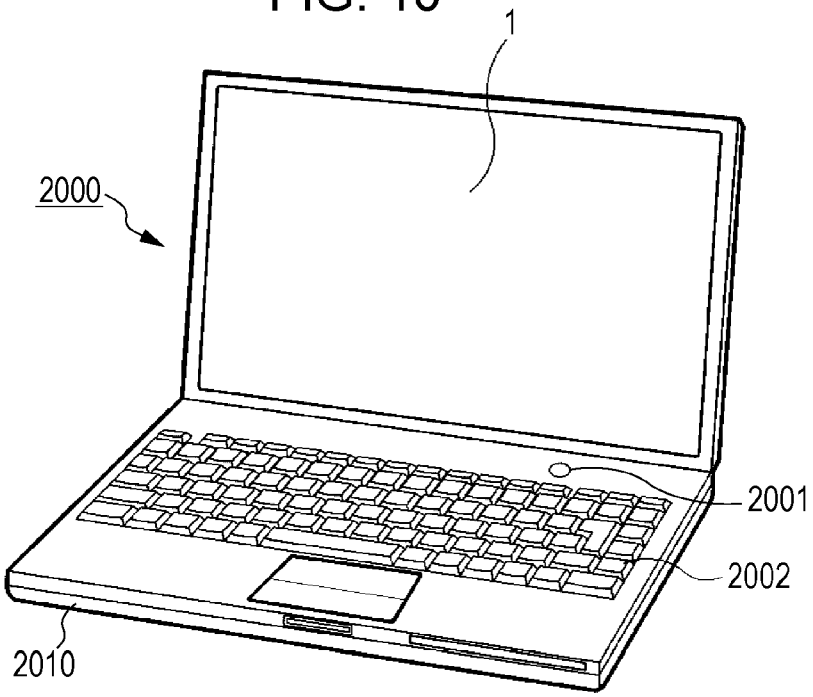
FIG. 10 is a diagram for describing an example of an electronic device.
Figure 11:
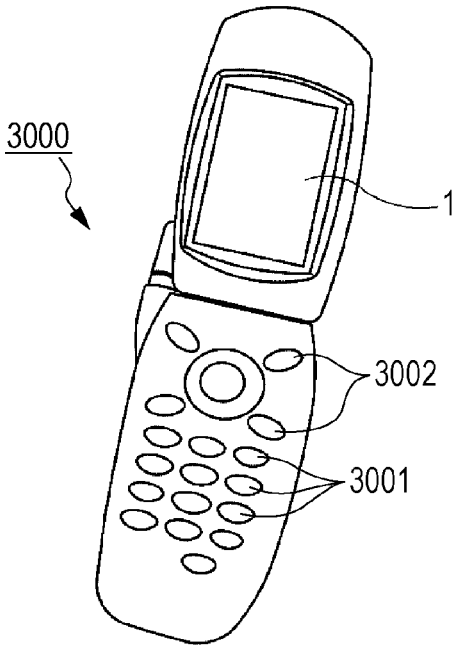
FIG. 11 is a diagram for describing an example of another electronic device.
Figure 12:
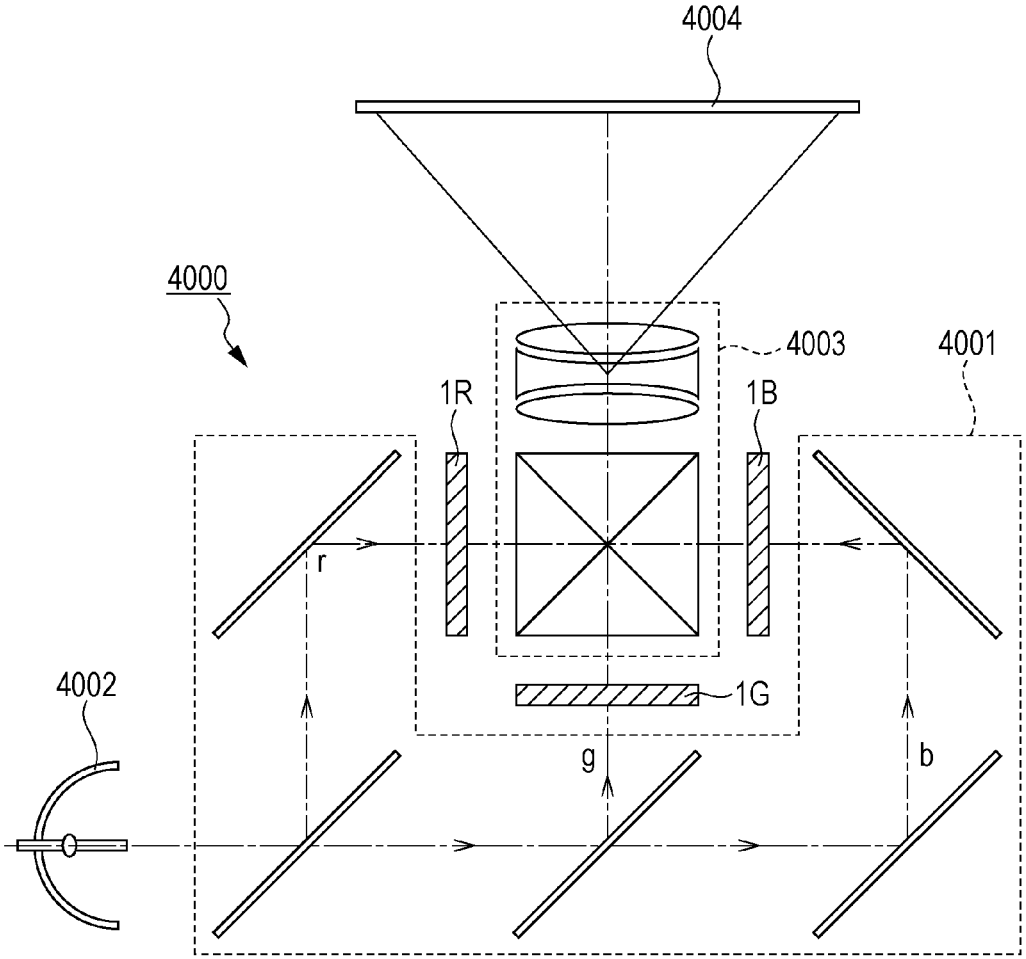
FIG. 12 is a diagram for describing an example of another electronic device.

The invention can be utilized in various electronic devices. In FIGS. 10 to 12, specific embodiments of electronic devices targeted for the application of the invention are exemplified.

FIG. 10 is a perspective view of a portable personal computer employing an electro-optic device. A personal computer 2000 includes an electro-optic device 1 for displaying various images and a body portion 2010 provided with a power switch 2001 and a keyboard 2002.

FIG. 11 is a perspective view of a mobile telephone. A mobile telephone 3000 includes a plurality of operation buttons 3001, a plurality of scroll buttons 3002 and an electro-optic device 1 for displaying various images. A screen displayed on the electro-optic device 1 is scrolled by operating any one of the scroll buttons 3002. The invention can be also applied to such a mobile telephone.

FIG. 12 is a schematic diagram illustrating a configuration of a projection type display device (three-plate type projector) 4000 employing an electro-optic device. This projection type display device 4000 includes three electro-optic devices 1 (1R, 1G and 1B) each associated with a corresponding one of mutually different display colors R, G and B. An illumination optical system 4001 supplies a red-color element r, a green-color element g and a blue-color element b, which are included in a light ray irradiated from an illumination device (light source) 4002, to an electro-optic device 1R, an electro-optic device 1G and an electro-optic device 1B, respectively. Each of the electro-optic devices 1 functions as a light modulator (a light valve) for modulating a corresponding single-color light ray supplied from the illumination optical system 4001. A projection optical system 4003 combines light rays each irradiated from a corresponding one of the electro-optic devices 1, and projects a resultant light ray to a projection face 4004. The invention can be also applied to such a liquid crystal projector.

In addition, electronic devices to which some aspects of the invention are applied include, besides the devices exemplified in FIG. 1 and FIGS. 10 to 12, a personal digital assistant (PDA), a digital still camera, a television set, a video camera, a car navigation device, an in-vehicle indicator (an instrument panel), an electronic diagram, electronic paper, an electronic calculator, a word processor, a work station, a video telephone, a POS terminal, a printer, a scanner, a copying machine, a video player, a device provided with a touch panel, and the like.

This application claims priority to Japan Patent Application No. 2013-217077 filed Oct. 18, 2013, the entire disclosures of which are hereby incorporated by reference in their entireties.

What is claimed is:

1. An electro-optic device comprising:

a plurality of scanning lines;

a plurality of signal lines;

a plurality of pixels each provided so as to correspond to one of intersections of the plurality of scanning lines and the plurality of signal lines;

a scanning line driving portion configured to perform scanning line driving operations each for selecting at least one of the scanning lines at a corresponding timing point in accordance with a vertical scanning frequency;

a signal line driving portion configured to supply the pixels, via the signal lines, with image signals each including at least time-division multiplexed data voltages each having a magnitude equivalent to a gray-scale level with which display is to be performed;

a signal line selection portion configured to perform signal selection operations in accordance with a control signal, each for selecting at least one signal line which is included in the signal lines, and through each of which a corresponding one of the image signals is supplied; and a controller that performs control so as to cause the vertical scanning frequency to be switched to any one of a first frequency and a second frequency which is higher than the first frequency, wherein the controller is configured to, in a state subsequent to switching of the vertical scanning frequency to the first frequency, output the control signal so as to, after an end of a first selection period for selecting at least one of the signal lines, cause any other at least one of the signal lines to be selected, and, in a state subsequent to switching of the vertical scanning frequency to the second frequency, output the control signal so as to, during a second selection period for selecting at least one of the signal lines, cause any other at least one of the signal lines to be selected, and thereby cause an overlapping period to arise during part of the second selection period for selecting at least one of the signal lines.

2. The electro-optic device according to claim 1, wherein the signal line driving portion is configured to, at intervals of one vertical scanning period, reverse a polarity of each of the image signals relative to a reference electric potential value for the pixels.

3. The electro-optic device according to claim 1, wherein the signal line driving portion is configured to, under control from the controller, be switched to any one of a three-dimensional view image driving operation, in which the image signals for a right-eye image and the image signals for a left-eye image are alternately supplied at intervals of a display period, and a two-dimensional view image driving operation, in which the image signals for images common to a right eye and a left eye are supplied, and the controller is configured to, when causing the signal line driving portion to be switched to the two-dimensional view image driving operation, perform control so as to cause the vertical scanning frequency to be switched to the first frequency, and when causing the signal line driving portion to be switched to the three-dimensional view image driving operation, perform control so as to cause the vertical scanning frequency to be switched to the second frequency.

4. The electro-optic device according to claim 1, further comprising:

a light source that is luminance-adjusted to at least a first luminance level and a second luminance level which is higher than the first luminance level; and a luminance detector that detects a luminance level under an installation environment where the electro-optic device according to claim 1 is installed, wherein, in the case where a luminance level under the installation environment, which is detected by the luminance detector, is lower than a third luminance level which is a reference level, the controller performs control so as to cause a luminance level of the light source to be switched to the first luminance level and cause the vertical scanning frequency to be switched to the first frequency, and in the case where the luminance level under the installation environment, which is detected by the luminance detector, is higher than or equal to the third luminance level, the controller performs control so as to cause a luminance level of the light source to be switched to the second luminance level and cause the vertical scanning frequency to be switched to the second frequency.

5. The electro-optic device according to claim 1, wherein the signal line driving portion is configured to, at least during a pre-charge period prior to operations for supplying the data voltages to the pixels, supply a pre-charge voltage such that the pre-charge voltage is supplied via at least one of the signal lines which is to be selected, and the controller is configured to, during the pre-charge period, output the control signal so as to cause all the signal lines to be selected.

6. The electro-optic device according to claim 5, wherein the scanning line driving portion is configured to, during the pre-charge period, supply each of the scanning lines with a scanning signal which causes corresponding ones of switching elements to be in an on-state.

7. The electro-optic device according to claim 5, wherein the controller is configured to output the control signal so as to, during an overall period from a beginning of the pre-charge period until an end of a selection period for firstly selecting at least one of the signal lines within one horizontal scanning period, cause the firstly selected at least one of the signal lines to be selected.

8. The electro-optic device according to claim 1, wherein the signal line selection portion is configured to, when needed, change order of the operations each for selecting at least one of the signal lines in accordance with the control signal.

9. A control method for an electro-optic device provided with a plurality of scanning lines, a plurality of signal lines and a plurality of pixels each provided so as to correspond to one of intersections of the plurality of scanning lines and the plurality of signal lines, the control method comprising;

performing scanning line driving operations each for selecting at least one of the scanning lines at a corresponding timing point in accordance with a vertical scanning frequency;

supplying the pixels, via the signal lines, with image signals each including at least time-division multiplexed data voltages each having a magnitude equivalent to a gray-scale level with which display is to be performed;

performing signal line selection operations in accordance with a control signal, each for selecting at least one signal line which is included in the signal lines, and through each of which a corresponding one of the image signals is supplied; and performing control so as to cause the vertical scanning frequency to be switched to any one of a first frequency and a second frequency which is higher than the first frequency, wherein, in a state subsequent to switching of the vertical scanning frequency to the first frequency, the control signal is outputted so as to, after an end of a first selection period for selecting at least one of the signal lines, cause any other at least one of the signal lines to be selected, and, in a state subsequent to switching of the vertical scanning frequency to the second frequency, the control signal is outputted so as to, during a second selection period for selecting at least one of the signal lines, cause any other at least one of the signal lines to be selected, and thereby cause an overlapping period to arise during part of the second selection period for selecting at least one of the signal lines.

10. An electronic device comprising the electro-optic device according to claim 1.

11. An electronic device comprising the electro-optic device according to claim 2.

12. An electronic device comprising the electro-optic device according to claim 3.

13. An electronic device comprising the electro-optic device according to claim 4.

14. An electronic device comprising the electro-optic device according to claim 5.

15. An electronic device comprising the electro-optic device according to claim 6.

16. An electronic device comprising the electro-optic device according to claim 7.

17. An electronic device comprising the electro-optic device according to claim 8.

* * * * *